United States Patent [19]

Ashdown et al.

[11] Patent Number: 5,024,695

[45] Date of Patent: Jun. 18, 1991

[54] FINE HOLLOW PARTICLES OF METALS AND METAL ALLOYS AND THEIR PRODUCTION

[75] Inventors: Charles P. Ashdown, Lowell; James G. Bewley, West Boxford; George B. Kenney, Medfield, all of Mass.

[73] Assignee: UltraFine Powder Technology, Inc., Ayer, Mass.

[21] Appl. No.: 263,048

[22] Filed: Oct. 26, 1988

Related U.S. Application Data

[60] Continuation-in-part of Ser. No. 825,079, Jan. 31, 1986, abandoned, Division of Ser. No. 634,785, Jul. 19, 1984, Pat. No. 4,626,278.

[51] Int. Cl.[5] ..... B22F 9/06

[52] U.S. Cl. ..... 75/338; 75/255

[58] Field of Search ..... 75/0.5 C; 264/12

[56] References Cited

U.S. PATENT DOCUMENTS 4,021,167 5/1977 Niimi et al. ..... 75/0.5 C
4,162,914 7/1979 Cremer ..... 75/0.5 BB
4,548,767 10/1985 Hendricks ..... 264/5
4,565,571 1/1986 Abbaschian ..... 75/0.5 C
4,626,278 12/1986 Kenney et al. ..... 75/0.5 C

FOREIGN PATENT DOCUMENTS 58-3904 1/1983 Japan ..... 75/0.5 A

*Primary Examiner*—Theodore Morris
*Assistant Examiner*—David Schumaker
*Attorney, Agent, or Firm*—Bromberg & Sunstein

[57] ABSTRACT

Soluble gas is introduced in a melt material which is then atomized and rapidly cooled. The cooling drives the gas from solution, further disintegrating the atomized material to an ultra-fine powder. In one embodiment the atomization and rapid cooling are effected using a gas atomization die. Introduction of the soluble gas may be effected by addition of reactive constituents to the melt, for reactively forming such gas. Finer powders with desirable metallurgical properties are formed using a metallic melt.

5 Claims, 4 Drawing Sheets

FINE HOLLOW PARTICLES OF METALS AND METAL ALLOYS AND THEIR PRODUCTION

The present invention is a continuation in part of U.S. application Ser. No. 825,079, filed Jan. 31, 1986, now abandoned which is hereby incorporated herein by reference and which in turn is a division of application Ser. No. 634,785, filed July 26, 1984, issued as U.S. Pat. No. 4,626,278 on Dec. 2, 1986.

TECHNICAL FIELD

The present invention relates to fine hollow or porous powders of metals and alloys and their production.

BACKGROUND OF THE INVENTION

U.S. Pat. No. 4,021,167, issued for an invention of Niimi et al., discloses an apparatus for manufacturing hollow spherical particles. The apparatus provides a large number of individual linear water jets arranged in a ring and converging at a single point so that a molten (ferrous) system containing graphite may be passed through this ring of water jets and the converging point. The carbon in the molten metal particles reacts with dissociated water molecules to form carbon monoxide and dioxide in the particles. Those gases, plus the freed hydrogen, oxygen, and sulfur dioxide gas, are said to form hollows in the particles. The particles range in size from 0.1 mm to 18 mm.

U.S. Pat. No. 4,565,571, issued for an invention of Abbaschiaw, discloses a method for producing hollow metallic spheres. Porous articles of sufficient strength are formed of a particulate material containing at least one electrically conductive metal. The porous article is subjected to an electromagnetic field which has a frequency sufficient to induce in the article an eddy current of such intensity to produce heat sufficient to melt the electrically conductive material. Heating of the molten article is continued for a time sufficient to expand any gas contained in the pores to a volume such that all of the entrapped pores combine to produce a hollow molten metal sphere, and then the sphere is cooled to solidify the molten metal.

U.S. Pat. No. 4,548,767 issued for an invention of Hendricks, discloses a method for producing small hollow spheres, the microspheres being made of glass, metal or plastic. In accordance with the invention, the sphere material is mixed with or contains as part of the composition a blowing agent which decomposes at high temperature. A droplet generator forms uniform size drops which then fall into an oven where water is removed leaving a solid particle. The solid particle then falls into a higher temperature zone of the oven where it is melted and the blowing agent decomposes. The gas from the decomposition blows the molten bubble into a microsphere of diameter ranging from 20 to 103 micrometers.

U.S. Pat. No. 4,162,914, issued for an invention of Cremer, et al., discloses a process for making hollow metal microballoons that can be filled with deuterium and tritium and used as laser and electronic beam targets for a fusion reaction. The process involves the formulation of clean, unoxidized metallic powders followed by inflation of the particles in a plasma arc. Water is introduced into the plasma so that the water disassociates partially into nascent hydrogen and nascent oxygen. The hydrogen is absorbed by the molten metallic particles. Subsequently atomic hydrogen dissolves and/or becomes molecular hydrogen and inflates the particles as they cool. The process produces microdiameter spheres in the range of 50–1000 micrometers.

SUMMARY OF INVENTION

The present invention concerns fine hollow particles of metals and alloys and a device and method for their production. The term "hollow" particles as used in this description and the following claims includes particles having a single hollow center as well as particles that, although not having a single hollow center, are nevertheless porous. In one embodiment of a method in accordance with the invention, a soluble gas is introduced into a molten metal bath by maintaining a pressurized atmosphere of the gas above the bath or by feeding the gas directly into the molten bath through a tube immersed into the bath. After the gas-saturated bath of metal is atomized into droplets by conventional kinetic gas atomization, the dissolved gas is rapidly rejected from the solidifying metal droplets, due to its dramatically decreased solubility in the solid state. At some point this rejected gas will nucleate a bubble in the supersaturated liquid remaining within the droplet and additional gas will rapidly diffuse to this bubble to expand it at high velocity. Under controlled conditions of initial soluble gas content, droplet size and droplet cooling rate, the bubble will grow to the point that it bursts to produce ultra fine powder particles according to the process as taught in the earlier U.S. Pat. No. 4,626,278. However, in accordance with the present invention, if less soluble gas is used, or a soluble gas is used which diffuses more slowly in the liquid metal, or if the cooling rate of the droplets is sufficiently accelerated, the process of bubble growth and disintegration can be arrested before the bubble actually bursts and hollow particles are thereby produced.

In another embodiment, the amount of soluble gas may be further reduced and the cooling rate further accelerated so that bubble nucleation is not allowed to occur and the soluble gas is largely trapped in solution in the solidified particles. These gas laden particles can then later be heated in vacuum or under some atmosphere for such times and temperatures (both above and below the liquidus of the alloy) that bubble nucleation and growth does occur and hollow particles are produced. In a variation of this embodiment, solid particles of gas-laden powder can be consolidated into parts by one of any number of processes such as injection molding, mechanical pressing, hot isostatic pressing, etc. The powder metal parts thus formed can be sintered at some elevated temperature to diffusion bond the particles together. Continued exposure at the sintering temperature or some higher or lower temperature can be employed to nucleate and grow bubbles within the powder particles so as to produce a very low density powder metal part.

In yet a third embodiment of the method, two or more soluble gases of varying solubilities and diffusion rates can be introduced into a molten metal bath. When this gas saturated bath is gas atomized into metal droplets, the faster diffusing gas (for example hydrogen) is largely rejected from the rapidly cooling and solidifying droplet to form and rapidly grow internal gas bubbles which under certain conditions will burst to produce the ultra fine particles. The slower diffusing gas (for example nitrogen) does not have sufficient time to diffuse to the internal bubbles or to escape the particles and will be largely trapped in solid solution within the ultra fine powder particles. When these very fine gas laden particles are later heated under the appropriate conditions of time and temperature (again, both above and below the alloy liquidus) they can be induced to nucleate and grow internal gas bubbles. A related device and the powders produced in accordance herewith also form a part of the invention.

BRIEF DESCRIPTION OF THE DRAWINGS

The foregoing features of the invention will be more readily understood by reference to the following description taken with the accompanying drawings, in which.

DETAILED DESCRIPTION OF THE INVENTION

The Tandem Atomization Process, as described in U.S. Pat. No. 4,626,278, dated Dec. 2, 1986, is a method for producing ultrafine metal powders utilizing a dissolved gas in tandem with kinetic gas atomization. Such powders are typically composed of particles having densities similar to those of solid metals. The present invention extends the Tandem Atomization Process to the production of fine hollow powders.

Although hollow powders are undesirable in many applications, the lower density and higher surface-area-to-mass ratio of hollow particles offer significant advantages in certain specific applications. For example, abradable seals employed in gas turbine engines to reduce the amount of hot gases which can by-pass turbine blades use very low density materials which can be readily abraded by the tips of the rotating turbine blades to form a close tolerance gas seal. Hollow powder particles, sintered together in the shape of a seal strip, will provide a low density, gas-tight, readily abradable seal for this application.

In other applications where surface-related properties such as electrical conductivity or magnetic energy absorption are important, coatings or even entire structures made from hollow particles can deliver these properties at considerable savings in weight and material.

Many other applications can be envisioned which take advantage of the strength and surface properties of fine powders in combination with the low weight and low density of hollow particles.

Figure 1:
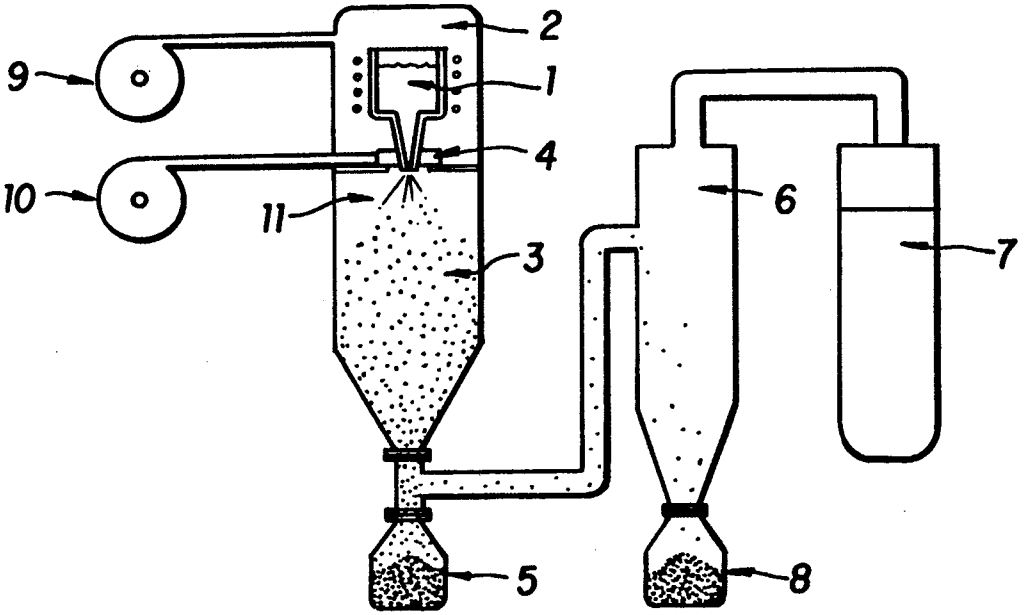
FIG. 1 shows a schematic of an apparatus according to a preferred embodiment of the invention.

FIG. 1 shows a schematic representation of a preferred embodiment of the invention. A melting furnace 1 holding a melt is contained within a melting chamber 2. A compressor 9 pressurizes the melting chamber 2 with a melt soluble gas, which dissolves in the melt within the melting chamber 2. Compressor 10 supplies an atomization gas (which need not be the same gas as the melt soluble gas) to kinetic gas atomization die 4, which also receives melt material from the melting chamber 2. The atomization die 4 atomizes the melt material having the melt soluble gas dissolved therein. The atomized melt material is directed by the atomization die 4 into an atomization chamber 3, which may also be pressurized in some embodiments. Coarse powder from the stream of atomized particles is collected in a coarse powder collector 5, while the finer particles are carried by the atomization gas flow to cyclone chamber 6 for further separation and collection of the relatively finer particles in product fine collector 8. Particles that are yet finer than those collected in product fine collector 8 remain entrained in the atomization gas and are carried into a bag house 7 wherein the dust from the atomizing gas is collected.

Figure 2:
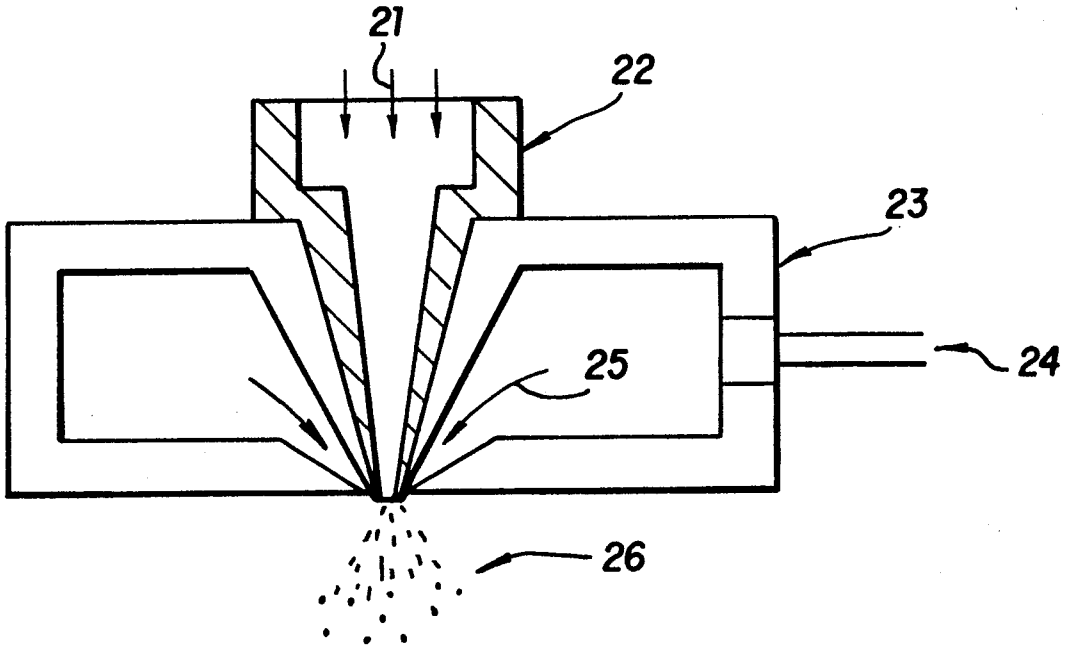
FIG. 2 is a cross section of an atomization die for use with the embodiment of FIG. 1.

FIG. 2 shows a cross section of the kinetic gas atomization die 4 of FIG. 1. Molten metal 21 flows into the die from the melting furnace 1 (shown in FIG. 1) through a conduit in a ceramic insert 22 in the atomization die 23. A pressurized stream of gas is introduced into the atomization die through gas inlet 24, resulting in gas flow 25 at appropriate angles and velocities to produce atomized metal droplets 26, in a manner well-known in the art. As discussed in further detail below these droplets contain one or more dissolved gases.

Figure 3:
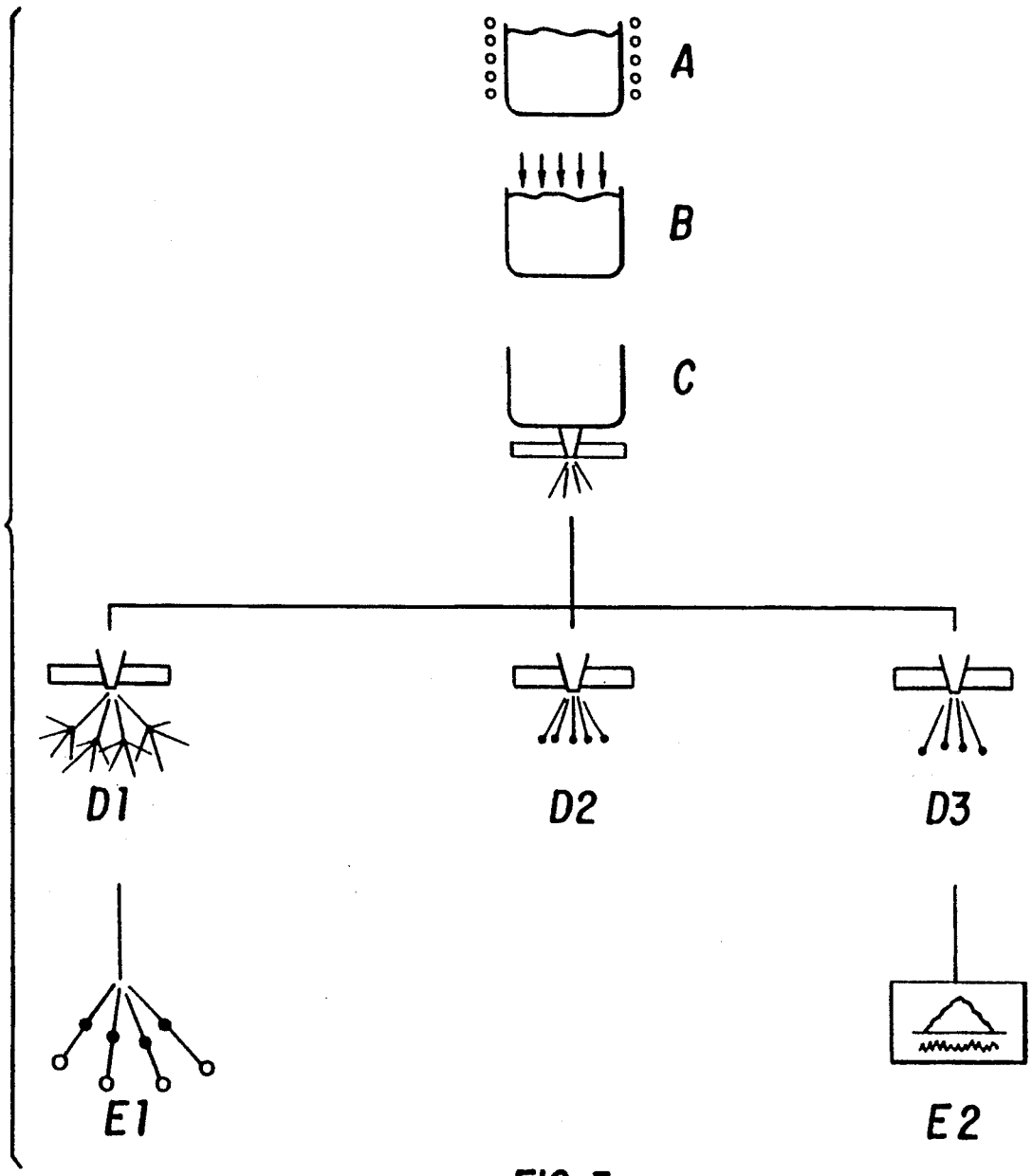
FIG. 3 shows a schematic representation of steps of various embodiments of the method in accordance with the present invention.

FIG. 3 shows a schematic representation of the steps of various embodiments of the method by which hollow metal particles are formed in accordance with the invention.

Step 3A of FIG. 3 shows the melt material in the melting furnace 1 of FIG. 1. The melt material is saturated with a melt soluble gas, which is maintained over the melt under pressure to allow dissolution of the melt soluble gas into the melt material as shown in step 3B of FIG. 3. (It will be appreciated that in some embodiments of the invention, complete saturation will not be necessary, it being sufficient to concentrate enough gas in solution that under subsequent conditions some of it can be evolved from solution to form hollow particles as understood herein.) Step 3C of FIG. 3 shows atomization of the melt material flowing through the atomization die of FIG. 2 by the atomization gas as described above with reference to FIG. 2. As a result, melt material is atomized into primary droplets.

Step D1 of FIG. 3 shows a representation of the method in accordance with U.S. Pat. No. 4,626,278, in which the dissolved gas comes suddenly out of solution when the primary droplets are directed into the atomization chamber 3 of FIG. 1, and explode into smaller, solid particles.

Step D2 of FIG. 3 shows one embodiment of the present invention in which the dissolved gas within the atomized particles nucleates and grows bubbles to produce hollow particles. The hollow particles so produced are then rapidly cooled before the dissolved gas remaining in solution in the partially solidified hollow particles can further expand the gas bubbles formed within the hollow particles, to cause the hollow particles to burst.

Step D3 of FIG. 3 represents another embodiment of the invention in which the dissolved gas remains in solid solution to produce solid particles. In this embodiment the atomized particles are rapidly cooled before any of the melt soluble gas dissolved therein can come out of solution and thereby nucleate and grow bubbles of gas within the atomized particle to create hollow particles. The solid particles can subsequently be heated, as shown in step E2, cause the melt-soluble gas to come out of solution at that time to nucleate and grow bubbles and thus to produce hollow metal particles. The gas-laden particles can be heated either in vacuum or under an atmosphere for such times and at such temperatures (both above and below the liquidus of the alloy) as to produce hollow particles of desired size and porosity.

In a further embodiment that bears some similarity to that of step D2 of FIG. 3, a plurality of gases (for example, two gases such as hydrogen and nitrogen) are dissolved (in step B of FIG. 3) in the molten metal. The gases are selected to have different diffusion rates. The faster diffusing of the two gases, hydrogen in the example, produces a first yield of droplets illustrated in step D1 of FIG. 3; this first yield still contains the gas with the slower diffusion rate. The slower diffusing of the two gases may, under appropriate conditions, nucleate and grow bubbles in the first yield of droplets to produce very small hollow particles according to step El of FIG. 3.

It will be appreciated that the concentration of dissolved gas in the melt may be varied to affect the results. When two or more dissolved gases are used, the concentration of each may be varied. Similarly the conditions in the atomization chamber of outside temperature and pressure experienced by the atomized droplets will also affect results. Moreover, it is possible to exert further control by adjusting partial gas pressures as well as the total pressure. All of these conditions may be varied in accordance with the results desired.

Figure 4A:
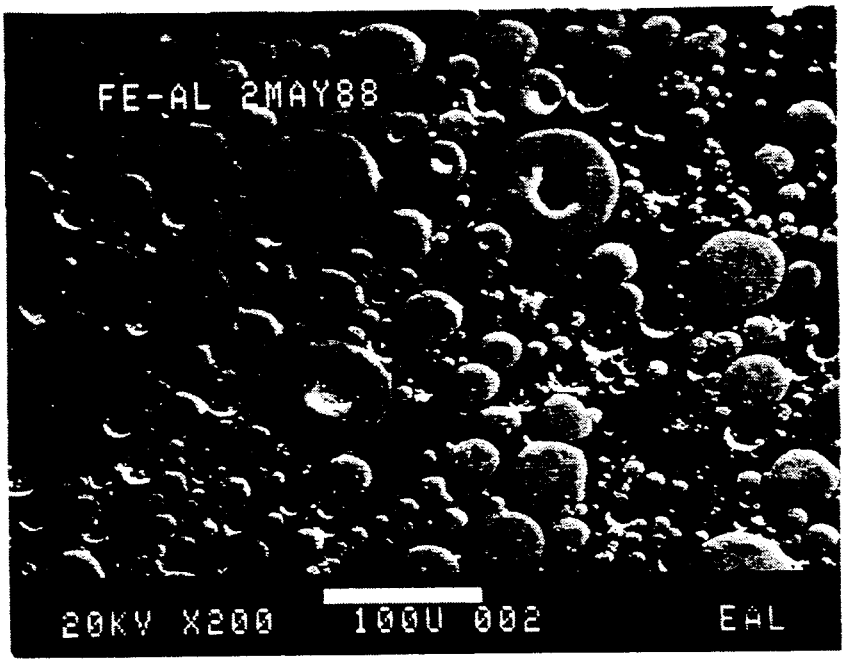
FIGS. 4A and 4B are electronmicrographs of hollow particles produced in accordance with the invention.
Figure 4B:
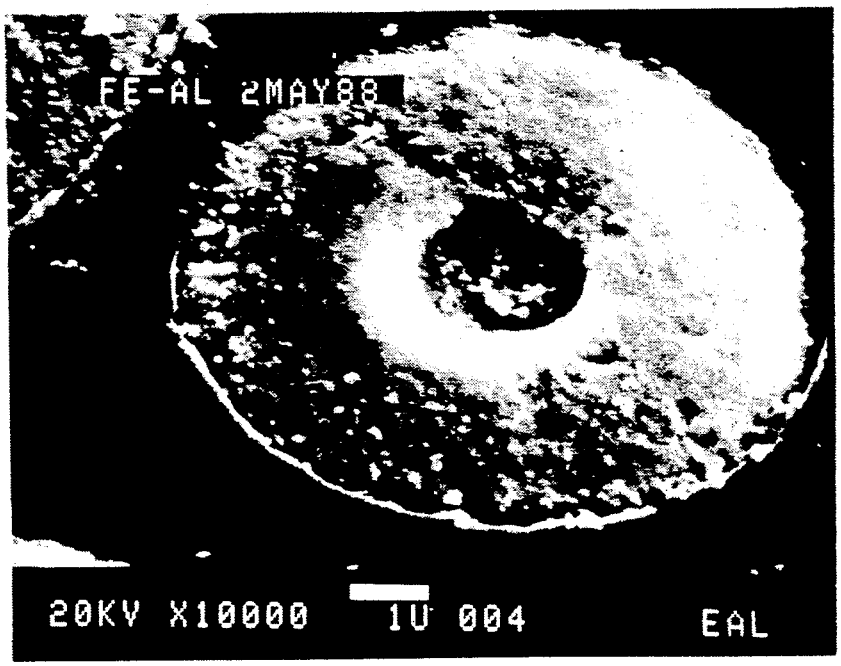

As one example of the foregoing invention, an iron base alloy consisting of iron with 5 percent aluminum was induction melted in an enclosed chamber similar to that illustrated in FIG. 1 above, except that all the powder was collected in fine collector 8 at the bottom of the cyclone chamber 6 without further separation. The molten material was then brought to a temperature of approximately 150°-200° C. above the melting point. Thereafter, one atmosphere of hydrogen gas was introduced into the melt chamber and held for approximately 15 minutes, a time sufficient to insure that the level of dissolved hydrogen in the melt had reached equilibrium. The hydrogen-saturated bath was then poured through a ceramic orifice and atomized, using an ordinary kinetic gas atomization arrangement, with 1800 psi of room temperature argon gas to produce a fine powder. During this process, the atomization chamber 3 contained argon at one atmosphere of pressure. The resulting hollow particles are illustrated in FIGS. 4A and 4B, which are electron micrographs showing cross sections of the particles at approximately 200 and 10,000 times magnification respectively. The mean diameter of the particles is approximately 10 microns. The resulting hollow particles illustrated in FIG. 4 were produced when hydrogen bubbles were nucleated within the atomized droplets and these droplets were then cooled and solidified before the hydrogen bubble could grow further to the point where rupture would occur.

It will be appreciated that the size of bubbles and the percent of hollow particles produced are influenced by the concentration of soluble gas introduced into the molten bath, the size and cooling rate of the droplets produced by gas atomization, the pressure differential between the melt chamber and the atomization chamber, the composition of the alloy, the temperature of the molten bath, and the properties of the soluble gas(es) being used, all of which may be varied in accordance with results desired.

What is claimed is:

1. A method of producing fine hollow metal particles from a melt material, the method comprising:

introducing into the melt material a melt-soluble gas, the gas being substantially more soluble in the liquid state than the solid state of the melt material, in concentration sufficient to cause the gas to come out of solution and form bubbles of the gas in droplets of the melt material formed after atomization thereof;

atomizing by kinetic spray atomization the melt material to produce atomized droplets of the melt material having the melt-soluble gas dissolved therein, the concentration of gas in the melt and the gas pressure and temperature outside of the droplets being in a range to cause the melt-soluble gas to come out of solution and so as to form the droplets into hollow metal particles.

2. A method according to claim 1, the method further comprising:

cooling the atomized droplets at a rate sufficient to cause solidification of a substantial proportion of the atomized droplets having bubbles of gas formed therein before the gas bubbles formed therein can further enlarge and burst the droplet.

3. A method for producing fine hollow metal particles from a melt material, the method comprising:

introducing into the melt material at least two melt soluble gases, the at least two soluble gases including a first gas and a second gas, wherein the second gas diffuses more slowly in the melt material than the first gas;

atomizing by kinetic spray atomization the melt material to produce a first yield of atomized droplets of the melt material having the at least two melt soluble gases dissolved therein, the concentration of the first and second gases in the melt, the partial pressures of the gases outside of the first yield of droplets, and the temperature outside of the first yield of droplets, being in a range to cause the diffusion of the first gas out of solution, forming bubbles in the first yield of droplets and bursting a substantial proportion thereof so as to form a second yield of droplets of the melt material, the droplets of the second yield being generally finer than those of the first yield, the temperature and the partial pressures of the gases outside of the second yield of droplets being in a range to cause solidification of a substantial proportion thereof only after the second gas begins to diffuse out of solution and so as to form the second yield of droplets into hollow metal particles.

4. A method for producing ultrafine hollow metal particles from a melt material, the method comprising:

introducing into the melt material a melt-soluble gas, the gas being substantially more soluble in the liquid state than the solid state of the melt material, in concentration sufficient to cause the gas to come out of solution and form bubbles of gas in droplets of the melt material formed after atomization thereof;

atomizing the melt material to produce atomized droplets of the melt material having the melt soluble gas dissolved therein;

rapidly cooling the atomized droplets at a rate sufficient to cause solidification of a substantial proportion of the atomized droplets before the melt-soluble gas dissolved therein can come out of solution and form bubbles of gas therein; and heating the solidified droplets having the melt-soluble gas dissolved therein for a period of time and at a temperature sufficient to cause the melt soluble gas dissolved therein to come out of solution and form bubbles of gas in the atomized droplets without causing the atomized droplets to burst.

5. A method for producing ultrafine hollow metal particles according to claim 4, wherein the step of atomizing includes atomizing by kinetic spray atomization.

* * * * *